US008245321B2

(12) United States Patent
Ambrosio et al.

(10) Patent No.: US 8,245,321 B2
(45) Date of Patent: Aug. 21, 2012

(54) GLOVE SYSTEM

(75) Inventors: Shannon Ambrosio, Palisades Park, NJ (US); Ellen Glassman, Closter, NJ (US)

(73) Assignee: Sears Brands, L.L.C.

( * ) Notice: Subject to any disclaimer, the term of this patent is extended or adjusted under 35 U.S.C. 154(b) by 287 days.

(21) Appl. No.: 12/634,835

(22) Filed: Dec. 10, 2009

(65) Prior Publication Data

US 2011/0138517 A1 Jun. 16, 2011

(51) Int. Cl.
*A41D 19/015* (2006.01)
*A41D 13/08* (2006.01)
*A41D 19/00* (2006.01)

(52) U.S. Cl. ..... 2/16; 2/159; 2/160; 2/161.6; 2/162; 2/170

(58) Field of Classification Search ..... 2/16–21, 2/158–160, 161.1–161.8, 162–170, 265, 2/267, 272
See application file for complete search history.

(56) References Cited

U.S. PATENT DOCUMENTS 1,433,145 A * 10/1922 Muhlenbruch ..... 2/162
1,664,542 A * 4/1928 Douglass ..... 2/161.6
1,748,833 A * 2/1930 Dunne ..... 2/159
1,820,960 A * 9/1931 Cunningham et al. ..... 362/197
1,934,332 A * 11/1933 Skinner ..... 2/162
3,103,016 A * 9/1963 Perlman ..... 2/270
3,140,495 A * 7/1964 Gottwik ..... 2/270
3,218,652 A * 11/1965 Madnick et al. ..... 2/270
3,605,117 A * 9/1971 Latina
4,004,295 A 1/1977 Byrnes, Sr.
4,089,070 A 5/1978 Cherry
4,094,014 A * 6/1978 Schroeder ..... 2/161.8
4,272,849 A 6/1981 Thurston et al.
4,326,706 A * 4/1982 Guthrie et al. ..... 482/105
4,384,449 A 5/1983 Byrnes, Sr. et al.
4,416,026 A * 11/1983 Smith ..... 2/161.6
4,843,650 A * 7/1989 Kangas et al. ..... 2/16
4,845,780 A * 7/1989 Reimers et al. ..... 2/160
4,864,660 A 9/1989 Sawyer
4,907,297 A * 3/1990 Gallucci ..... 2/163
5,146,628 A 9/1992 Herrmann et al.
5,218,719 A 6/1993 Johnson
5,353,440 A * 10/1994 Meldeau ..... 2/161.1
5,412,545 A * 5/1995 Rising ..... 362/105
5,425,142 A 6/1995 Scott
5,435,007 A * 7/1995 Kalvestran et al. ..... 2/16

(Continued)

FOREIGN PATENT DOCUMENTS

WO WO 02/047775 A3 6/2002

OTHER PUBLICATIONS

US 4,675,913, 06/1987, Rockwell (withdrawn)

*Primary Examiner* — Bobby Muromoto, Jr.
(74) *Attorney, Agent, or Firm* — McAndrews, Held & Malloy, Ltd.

(57) ABSTRACT

A glove system including a glove and a wrist attachment. The glove has a base portion, which includes a first fastener. The wrist attachment includes one or more straps for enabling wearing of the wrist attachment on a human wrist, a functional feature, and a second fastener adapted to couple with the first fastener and for selectively attaching the first wrist attachment to the glove.

23 Claims, 6 Drawing Sheets

U.S. PATENT DOCUMENTS 5,442,815 A 8/1995 Cordova et al.
5,459,883 A * 10/1995 Garceau-Verbeck ..... 2/161.1
5,467,483 A * 11/1995 Saadatmanesh et al. ..... 2/161.7
5,537,692 A * 7/1996 Dorr ..... 2/161.1
5,557,803 A 9/1996 Granich et al.
5,568,657 A 10/1996 Cordova et al.
5,580,154 A 12/1996 Coulter et al.
5,593,073 A 1/1997 Finnegan
5,600,849 A * 2/1997 Hu ..... 2/16
5,600,853 A 2/1997 Yewer, Jr.
5,640,712 A 6/1997 Hansen et al.
5,715,539 A * 2/1998 Benecki et al. ..... 2/160
5,720,046 A * 2/1998 Lopez et al. ..... 2/159
5,790,980 A 8/1998 Yewer, Jr.
5,826,276 A * 10/1998 Garceau-Verbeck ..... 2/161.1
5,829,061 A 11/1998 Visgil et al.
5,983,396 A * 11/1999 Morrow et al. ..... 2/161.1
6,014,775 A * 1/2000 Missry ..... 2/161.2
6,021,523 A 2/2000 Vero
6,141,801 A * 11/2000 Helenick ..... 2/159
6,185,747 B1 2/2001 Hughes
6,216,276 B1 4/2001 Eibert
6,275,996 B1 * 8/2001 Redwood et al. ..... 2/160
6,279,159 B1 * 8/2001 Ahlbaumer et al. ..... 2/20
6,643,845 B2 11/2003 O'Dea et al.
6,708,346 B2 3/2004 Terris et al.
D492,088 S 6/2004 Hatch et al.
6,775,847 B2 8/2004 Terris et al.
6,779,199 B1 8/2004 O'Dea et al.
6,832,391 B1 12/2004 Bower
6,842,722 B2 1/2005 David
6,892,397 B2 5/2005 Raz et al.
7,146,651 B1 * 12/2006 Lapin ..... 2/338
7,159,246 B2 * 1/2007 Tippey ..... 2/163
7,163,308 B2 * 1/2007 Ferrari et al. ..... 362/103
7,254,840 B2 8/2007 Hammons et al.
7,363,660 B1 * 4/2008 Gilliland et al. ..... 2/161.6
7,469,426 B2 12/2008 Roeckl
D589,678 S 4/2009 Lawrence
7,584,519 B2 9/2009 Ouellette et al.
7,971,277 B2 * 7/2011 Romiti ..... 2/162
2001/0019598 A1 * 9/2001 Pyles ..... 377/5
2002/0189007 A1 * 12/2002 Cormier ..... 2/457
2003/0164389 A1 * 9/2003 Byers ..... 224/221
2004/0249990 A1 * 12/2004 Yin ..... 710/1
2004/0260281 A1 * 12/2004 Baxter et al. ..... 606/41
2005/0068767 A1 * 3/2005 Uke et al. ..... 362/202
2005/0104741 A1 * 5/2005 Kimbrough, Jr. ..... 340/815.45
2005/0142967 A1 * 6/2005 Vito et al. ..... 442/104
2005/0223469 A1 10/2005 Banton
2006/0085801 A1 * 4/2006 Cheah et al. ..... 720/600
2006/0109645 A1 * 5/2006 Ferrari et al. ..... 362/103
2006/0185057 A1 * 8/2006 Terpinski ..... 2/160
2006/0198133 A1 * 9/2006 Mah ..... 362/202
2007/0194066 A1 * 8/2007 Ishihara et al. ..... 224/164
2008/0294019 A1 * 11/2008 Tran ..... 600/301
2009/0112601 A1 * 4/2009 Fullmer ..... 704/271
2009/0141261 A1 * 6/2009 Lukas et al. ..... 356/4.01
2009/0158495 A1 * 6/2009 Flynn ..... 2/160
2010/0095427 A1 * 4/2010 Romiti ..... 2/160
2010/0159798 A1 * 6/2010 Bertrand et al. ..... 446/259
2011/0035861 A1 * 2/2011 McDonald ..... 2/161.1
2011/0110074 A1 * 5/2011 Cameron ..... 362/103

* cited by examiner

GLOVE SYSTEM

BACKGROUND

Numerous types of gloves have already been proposed, differing in particular in shape and/or in the material from which they are made. Nevertheless, no presently available glove fully satisfies the various needs of a user. In particular, known gloves are not adaptable based on the user's needs in different situations.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An embodiment of the present invention is directed to a glove system including a glove and a wrist attachment. The glove has a base portion, which includes a first fastener. The wrist attachment includes one or more straps for enabling wearing of the wrist attachment on a human wrist, a functional feature, and a second fastener adapted to couple with the first fastener and for selectively attaching the first wrist attachment to the glove.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known components have not been described in detail as not to unnecessarily obscure aspects of the present invention.

Generally speaking, embodiments provide a glove system wherein one or more wrist attachments having associated features adapted for different applications may be provided for attachment to a glove. The wrist attachments may include a magnetic region for securing tools, fasteners or other metallic objects, a swiveling flashlight, a laser measurer, a digital voice recorder, a digital audio player, a laser level, a snake-light, a heart rate monitor, a pedometer, a compass, a stop-watch or a global positioning system (GPS) unit, but is not limited as such. As further described hereinbelow with reference to the figures, the gloves and wrist attachments according to various embodiments may also include a number of additional features designed to make them more comfortable, more durable and/or more tactile.

Figure 1B:
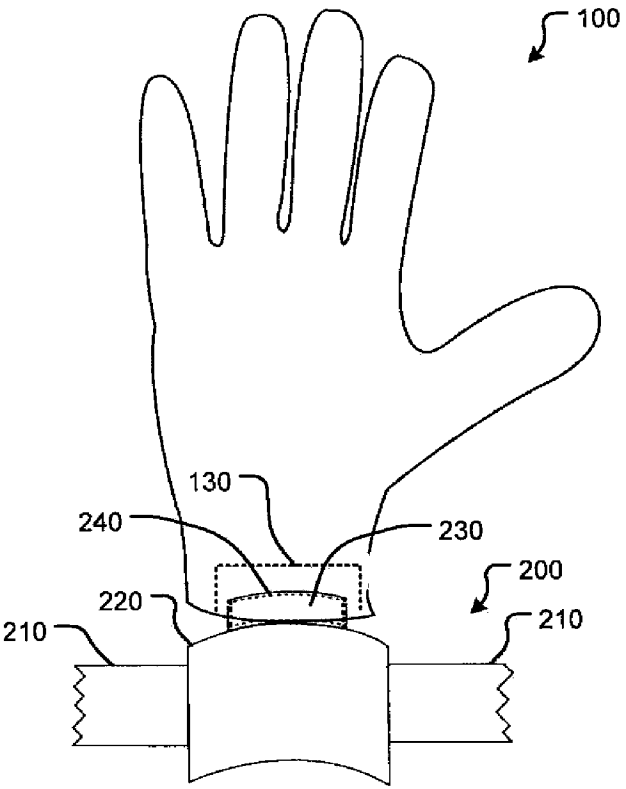
FIG. 1B illustrates a glove system, in accordance with an embodiment, wherein a glove and a wrist attachment connected.
Figure 1A:
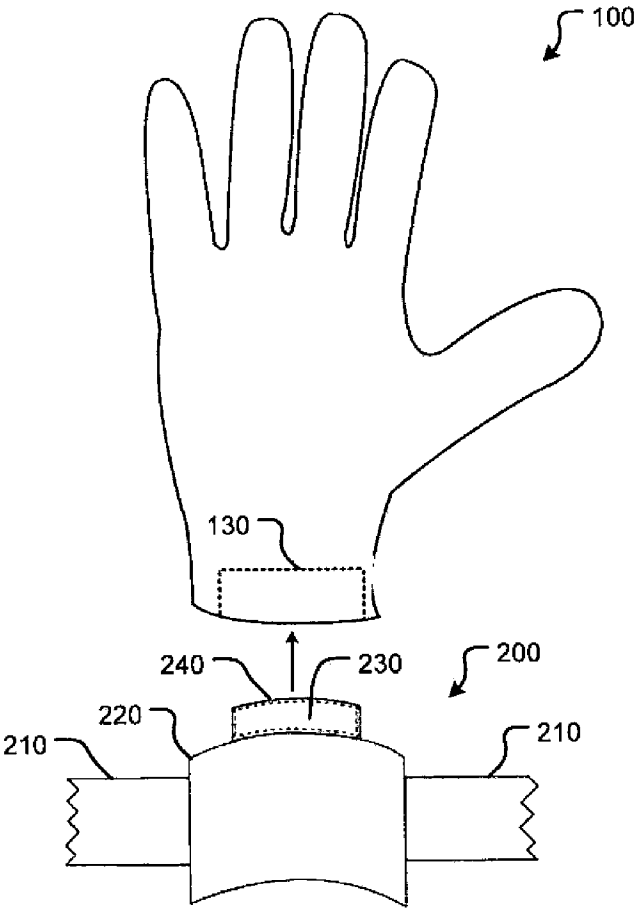
FIG. 1A illustrates a glove system, in accordance with an embodiment, wherein a glove and a wrist attachment are separated.
Figure 2B:
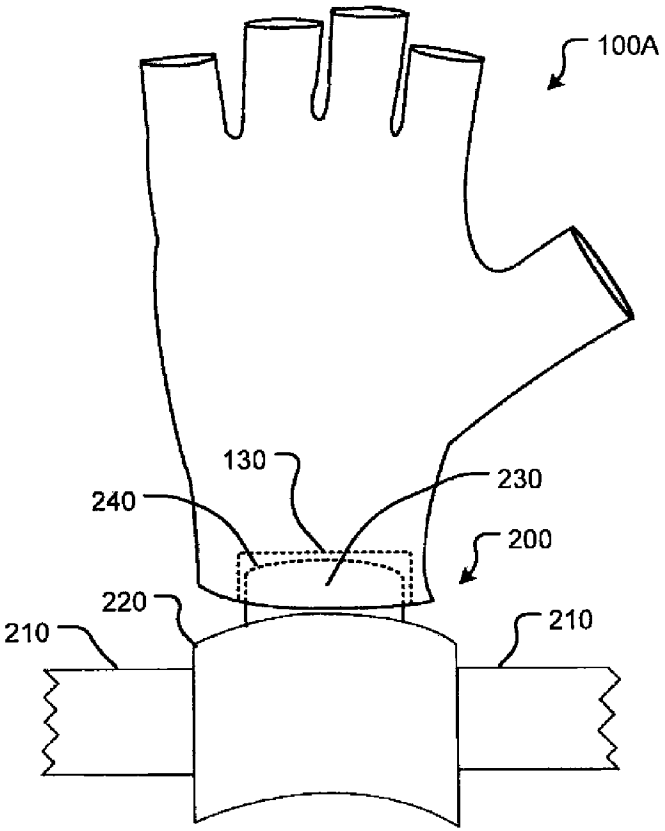
FIG. 2B illustrates a glove system, in accordance with an embodiment, wherein a partial-finger glove and a wrist attachment are connected.
Figure 2A:
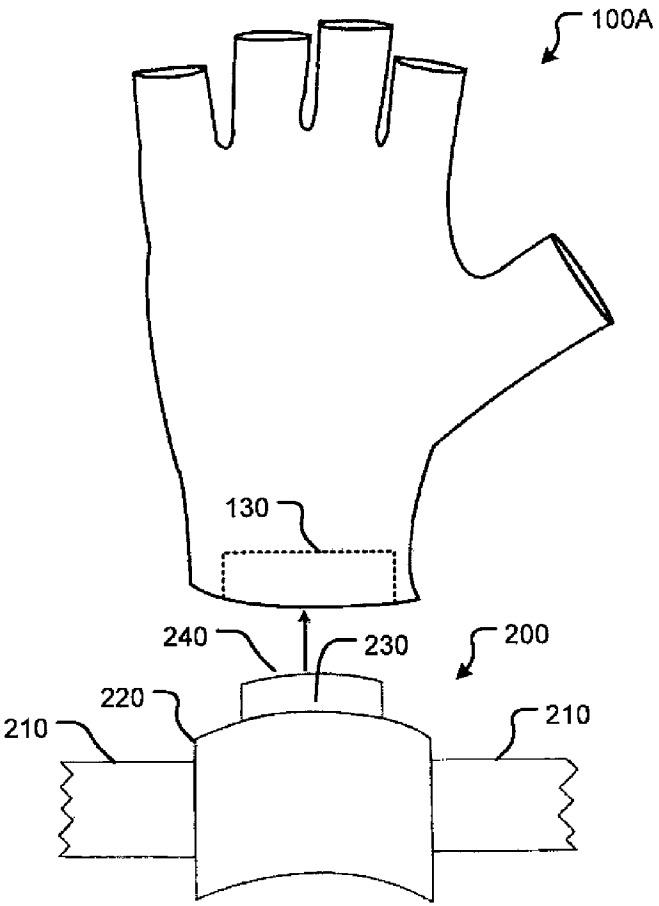
FIG. 2A illustrates a glove system, in accordance with an embodiment, wherein a partial-finger glove and a wrist attachment are separated.

FIGS. 1A and 1B illustrate a glove system, in accordance with various embodiments of the present invention. As shown, the glove system includes a glove 100 and a selectively attachable wrist attachment 200. While glove 100 is depicted as a full-fingered glove, it should be appreciated that the glove 100 may also be a partial-fingered glove, such as glove 100A depicted in FIGS. 2A and 2B, as well as any other type of glove known in the art.

The wrist attachment 200 includes one or more wrist straps 210, for enabling wearing of the wrist attachment 200 interchangeably on either the left or right wrist. The wrist attachment also includes a functional portion 220 for providing various functional features, as described hereunder.

The glove 100 and wrist attachment 200 may be attached to each other, as shown in FIG. 1B, by means of mating fasteners 130 and 230 on the glove 100 and wrist attachment 200, respectively. The fasteners 130 and 230 may be mating strips of hook-and-loop fasteners, mating snaps or the like. In one embodiment, the fastener 130 of the glove 100 may be disposed along the inward-facing surface of a base portion of the glove 100, and the fastener 230 of the wrist attachment 200 may be disposed on an outward-facing surface of a tab 240 that extends out from the functional portion 220 and towards the glove 100.

Figure 3:
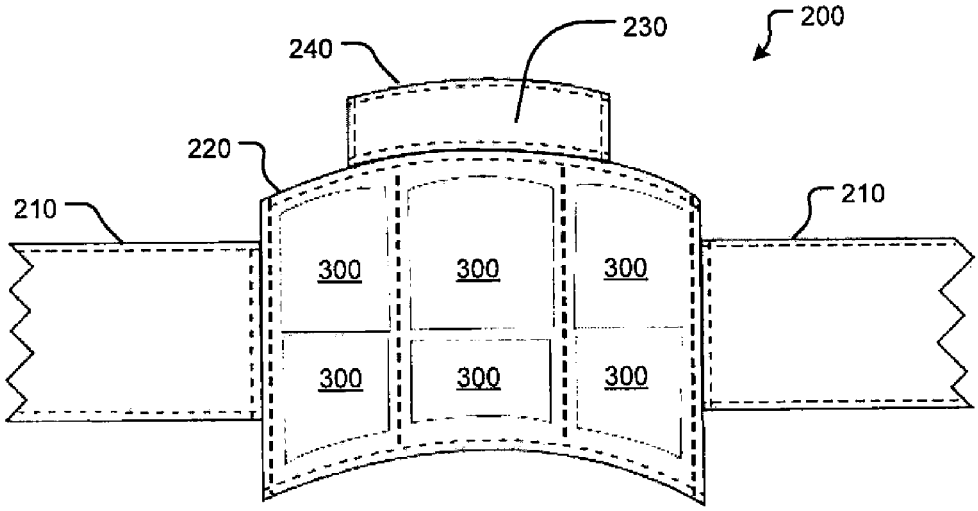
FIG. 3 illustrates a wrist attachment having a magnetic cuff, in accordance with an embodiment.

FIG. 3 illustrates a wrist attachment 200 according to one embodiment. As shown, the functional portion 220 of the wrist attachment 200 may include one or more magnets 300, which may be stitched into the fabric of the functional portion 220. This provides a user with a convenient place to put small tools and fasteners such as nails, screws, nuts, bolts and the like, and other metal objects, while the user is working Accordingly, the inclusion of magnets 300 in the functional portion 220 eliminates misplacing such metal objects or having to place them in another, less convenient location.

Figure 4:
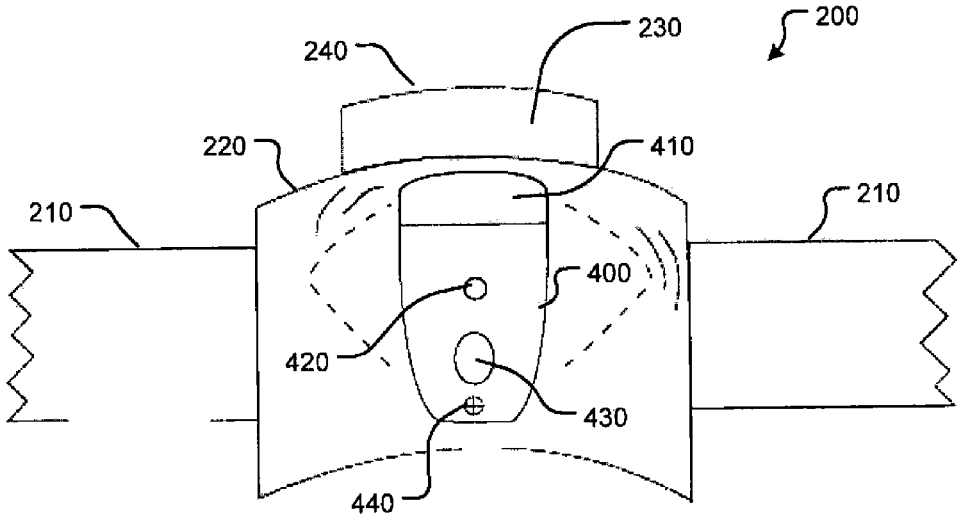
FIG. 4 illustrates a wrist attachment having a light attachment, in accordance with an embodiment.

FIG. 4 illustrates a wrist attachment 200 according to another embodiment. As shown in FIG. 4, the functional portion 220 of the wrist attachment 200 may include a flashlight 400. Since use of the present embodiment in rainy conditions is contemplated, the wrist attachment 200 may be made of a water-resistant material, such as polyurethane, to help prevent moisture from penetrating the inside of the flashlight 400. Likewise, the flashlight 400 itself may also be waterproof. Such a wrist attachment may be desirable for a mechanic or other type of technician that must work in tight, poorly lit areas. It may also be desirable for a bicyclist or motorcyclist.

The flashlight includes a spotlight 410, which may utilize an incandescent bulb or a light emitting diode (LED) as its light source. In one embodiment, the flashlight 400 may swivel about a pivot point 440 to permit positioning at various angles. The flashlight may also include an indicator light 420, which, in one embodiment, may be configurable to blink periodically. This is particularly advantageous for bicyclists or motorcyclists, as it makes the rider more visible and allows for easier location of the rider in the event of an accident in which the rider is ejected.

The flashlight 400 may include one or more operational buttons 430 for controlling the operation of the flashlight 400, including operation of the spotlight 410 and the indicator light 420. In the illustrated embodiment, the flashlight 400 is controlled by a single operational button 430. In such a single-button embodiment, the button 430 may be used to toggle the flashlight 400 through various functional states based on the number of times the button 430 is pressed. By way of example only, and not limitation, when the flashlight is in an off state, a first press of the button 430 may activate the spotlight 410. A second press of the button 430 may then activate the indicator light 420 and deactivate the spotlight 410. A third press of the button 430 may then activate both the spotlight 410 and the indicator light 420. Finally, a fourth press of the button 430 may return the flashlight 400 to the off state.

Figure 5:
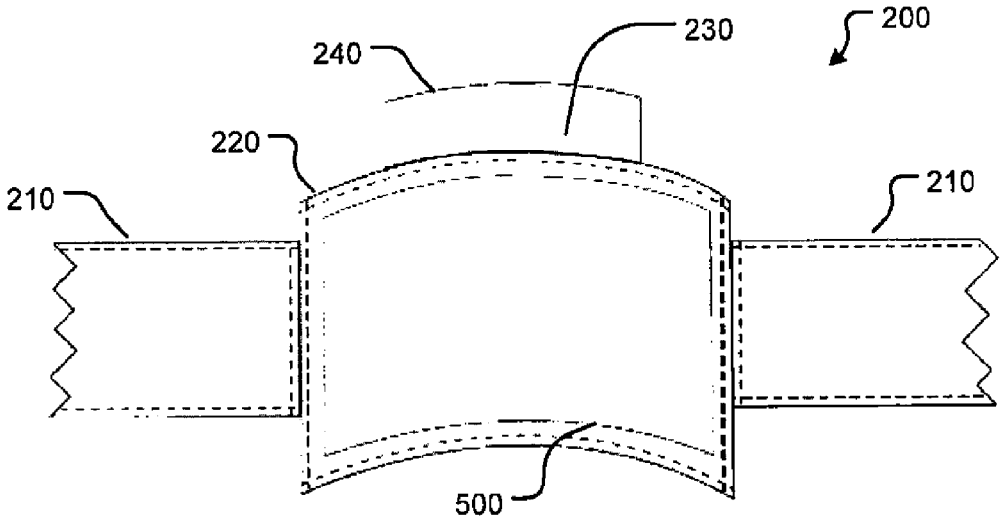
FIG. 5 illustrates a wrist attachment having anti-fatique gel disposed therein, in accordance with an embodiment.

In either of the wrist attachment 200 embodiments depicted in FIG. 3 or FIG. 4, as well as in any other embodiments contemplated herein, a layer of anti-fatigue gel 500, such as that depicted in FIG. 5, may be provided between the magnet(s) 300 or flashlight 400 and the wrist-facing surface of the wrist attachment 200, to thereby provide greater confort to the wearer. The anti-fatigue gel 500 may be any of a number of materials, including, but not limited to, a viscoelastic polymer, polyurethane (PUR or PU), polyvinyl chloride (PVC) and silicone. If silicone is used, the silicone may be a silicone-based rubber, a silicone-based resin or a silicone-based polymer.

Figure 6:
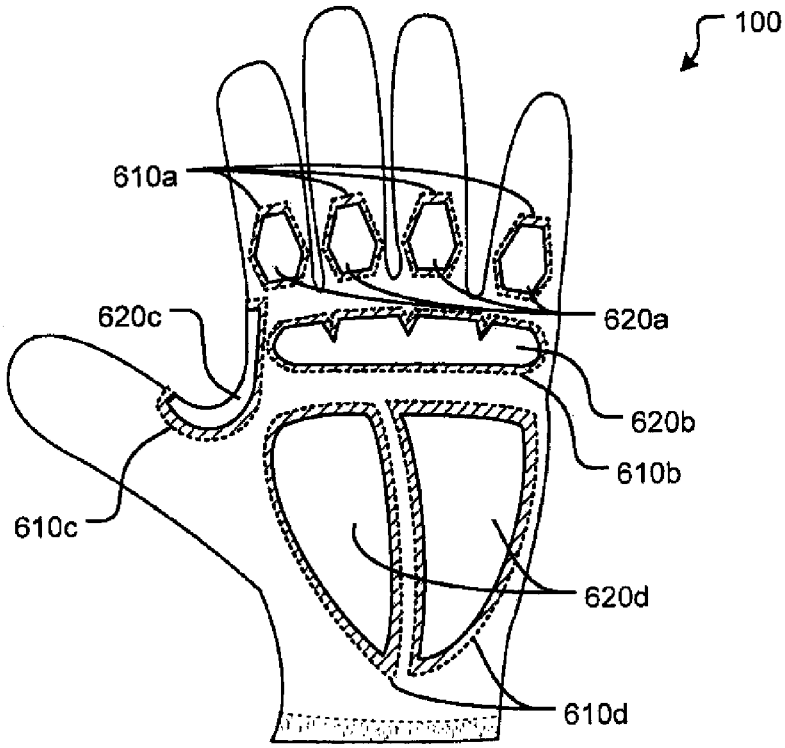
FIG. 6 illustrates the palmar side of a glove having anti-fatigue gel disposed therein and grip-enhancing material disposed thereon, in accordance with an embodiment.

Like the wrist attachment 200, anti-fatigue gel 610 can also be added to the glove 100 to enhance the comfort for the wearer and alleviate stress and fatigue caused by constant trauma and impact when holding/gripping hand-held tools and power tools, a car steering wheel, motorcycle handlebars, etc. The anti-fatigue gel 610 may be added to the glove 100, for example, by stitching it into the fabric of the glove 100. The anti-fatigue gel 610 may be added to various locations 610*a-d* on the palmar side of the glove 100, as shown in FIG. 6. The loci of the anti-fatigue gel 610 may correspond to various pressure points of the palm. For example, the anti-fatigue gel may be disposed over one or more proximal phalanges (i.e. location 610*a*), over one or more of the metacarpophalangeal joints (i.e. location 610*b*), over the crotch of the thumb (i.e. location 620*c*), and/or over the thenar and hyper-thenar regions of palm (i.e. location 610*d*).

A grip-enhancing material 620 may also be added to various locations on the palmar surface of the glove 100, in addition to or instead of the anti-fatigue gel 610. In one embodiment, the grip-enhancing material 620 may be a silicone-based material, such as a silicone-based rubber, a silicone-based resin or a silicone-based polymer. The gripper material 620 may be added to various locations 620*a-d* on the palmar side of the glove 100, as shown in FIG. 6. The loci of the gripper material 620 may likewise correspond to various pressure points of the palm, including, but not limited to, being disposed over one or more proximal phalanges (i.e. location 620*a*), over one or more of the metacarpophalangeal joints (i.e. location 620*b*), over the crotch of the thumb (i.e. location 630*c*), and/or over the thenar and hyper-thenar regions of palm (i.e. location 640*d*). In embodiments where the glove 100 includes both the anti-fatigue gel 610 and the grip-enhancing material 620, the grip-enhancing material may applied on top of the fabric sewn over the anti-fatigue gel 610. However, while FIG. 6 depicts a glove having both the anti-fatigue gel 610 and the grip-enhancing material 620, it should be appreciated that some embodiments may only include one of the two materials.

Figure 7:
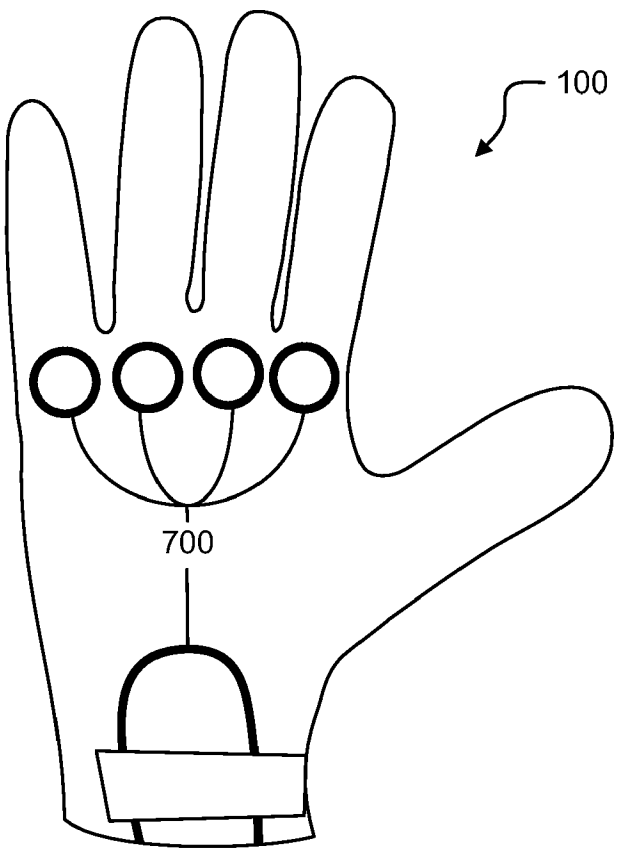
FIG. 7 illustrates the dorsal side of a glove including reflective material, in accordance with an embodiment.

FIG. 7 illustrates the dorsal side of a glove 100 according to an embodiment. In the illustrated embodiment, the glove 100 includes reflective material 700 disposed at a plurality of locations—namely over the metacarpophalangeal joints and over the base of the hand—to enhance the visibility of the wearer at night and in other low-light conditions. This is particularly useful for runners, bicyclists, motorcyclists, road construction workers, etc. It should be appreciated that the locations depicted in FIG. 7 are merely exemplary, and embodiments are not limited as such.

Figure 8:
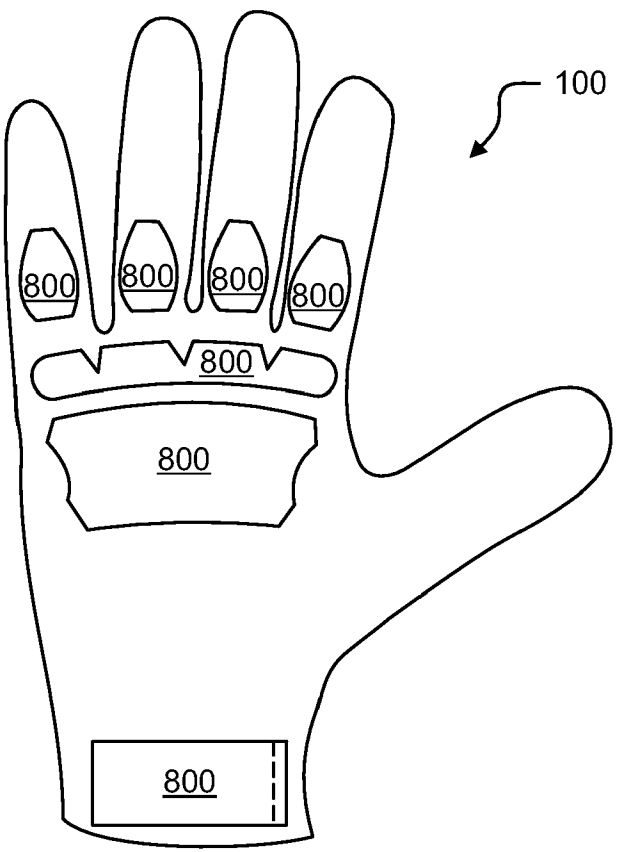
FIG. 8 illustrates the dorsal side of a glove including abrasion-resistant material, in accordance with an embodiment.

FIG. 8 illustrates the dorsal side of a glove 100 according to another embodiment. In the illustrated embodiment, the glove 100 includes anti-abrasion material 800 disposed at a plurality of locations—namely over the proximal phalanges, over the metacarpophalangeal joints, over the metacarpals and over the wrist—to protect the wearer from abrasions and laceration. This is particularly useful for bicyclists, motorcyclists, construction workers, etc. It should be appreciated that the locations depicted in FIG. 8 are merely exemplary, and embodiments are not limited as such. The anti-abrasion material can be any of a number of materials, including but not limited to polyurethane, polyvinyl chloride, silicone and/or a para-aramid fiber.

Figure 9:
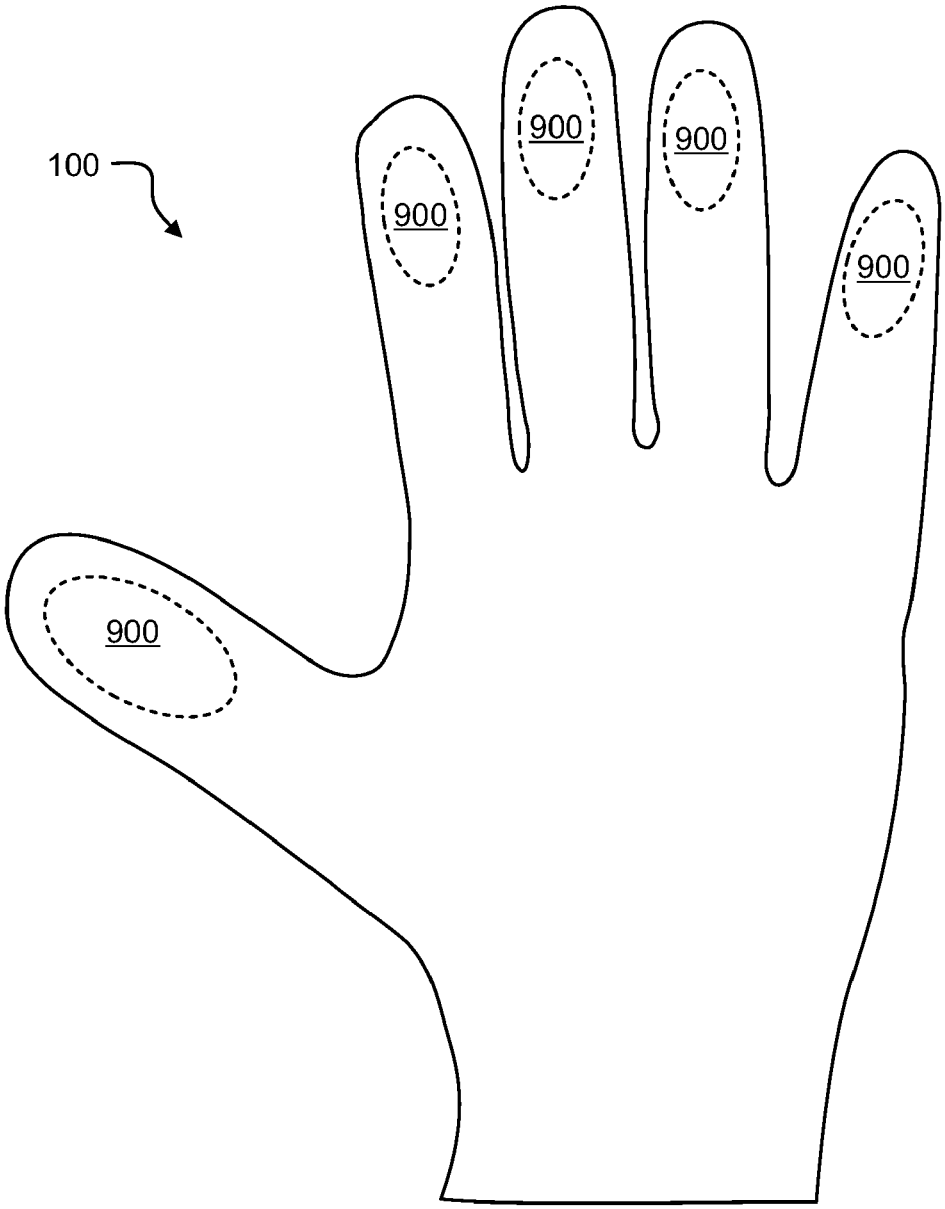
FIG. 9 illustrates the palmar side of a glove having magnetic fingertips, in accordance with an embodiment.

FIG. 9 illustrates the palmar side of a glove 100 according to another embodiment. In the illustrated embodiment, the glove 100 includes magnets 900 disposed at the fingertips. This provides a worker better grip and control over nails, screws, fasteners and other metal objects, particularly when working in tight spaces. While FIG. 9 depicts the magnets 900 as being disposed at each fingertip, it should be appreciated that it may not be necessary to include them in each finger. For example, it may be desirable to have a magnet 900 in only one of the fingers, such as the index finger, to stabilize the metal object, while the other fingers can manipulate the metal object without having it stick to them.

Thus, embodiments provide a glove system having one or more interchangeable wrist attachments with associated features, such as a magnet or a flashlight. By providing interchangeable wrist attachments, a glove can thereby be adapted to multiple different applications without the need for a multiple pairs of gloves. Further, a user could use two different attachments at once (e.g. a magnetic wrist attachment on one hand and a flashlight wrist attachment on the other). The glove itself may be further enhanced by adding certain specialized materials to the glove. In particular, anti-fatigue gel can be added to the glove to relieve the stress of pressure and impact, anti-abrasion material can be added to the glove to make the glove more durable and to protect the wearer, and grip-enhancing material can be added to the glove to make the glove more tactile.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A glove system, comprising:

a glove having an interior surface and an exterior surface, the interior surface of the glove having a palm-facing surface for facing a palm of a wearer's hand and a dorsal-facing surface for facing a dorsal side of the wearer's hand, the dorsal-facing surface having disposed thereon a first hook-and-loop fastener; and a wrist attachment comprising:

an elongate main body having an interior surface, an exterior surface, a first end and a second end, the first and second ends each having associated therewith respective fasteners, wherein the elongate main body is adapted to wrap around a wrist of the wearer such that the first and second ends attach to each other via their respective fasteners;

a swiveling flashlight disposed along the exterior surface of the elongate main body and having a spotlight, an indicator light that periodically blinks when operated, and a single operational button for controlling both the spotlight and the indicator light, wherein the spotlight and the indicator light operate simultaneously in at least one mode of operation of the swiveling flashlight; and an attachment member extending outwardly from the elongate main body and adapted to be inserted into the glove, the attachment member having an interior surface and an exterior surface, the exterior surface of the attachment member having disposed thereon a second hook-and-loop fastener, wherein the attachment member is adapted to be inserted into the glove while both the glove and the wrist attachment are being worn by a wearer and the second hook-and-loop fastener is adapted to mate with the first hook-and-loop fastener, thereby attaching the wrist attachment to the glove.

2. The glove system as recited in claim 1, wherein a first number of presses of the operational button activates the spotlight.

3. The glove system as recited in claim 2, wherein a second number of presses of the operational button activates the indicator light.

4. The glove system as recited in claim 3, wherein a third number of presses of the operational button activates the spotlight and the indicator light.

5. The glove system as recited in claim 1, wherein the swiveling flashlight is waterproof.

6. The glove system as recited in claim 1, wherein the wrist attachment comprises a layer of anti-fatigue gel disposed between the interior and exterior surfaces of the elongate main body of the wrist attachment.

7. The glove system as recited in claim 1, wherein the glove comprises anti-abrasion material disposed at a plurality of loci on a dorsal side of the glove.

8. The glove system as recited in claim 7, wherein the anti-abrasion material comprises polyurethane.

9. The glove system as recited in claim 7, wherein the anti-abrasion material comprises polyvinyl chloride.

10. The glove system as recited in claim 7, wherein the anti-abrasion material comprises silicone.

11. The glove system as recited in claim 7, wherein the anti-abrasion material comprises a para-aramid fiber.

12. The glove system as recited in claim 7, wherein the plurality of loci on the dorsal side of the glove consist of:

generally over the wrist joint;

generally over one or more of the metacarpals;

generally over one or more of the metacarpophalangeal joints; and generally over one or more of the proximal phalanges.

13. The glove system as recited in claim 1, wherein the glove comprises grip-enhancing material disposed at a plurality of loci on a palmar side of the glove.

14. The glove system as recited in claim 13, wherein the gip-enhancing material comprises a silicone-based material.

15. The glove system as recited in claim 1, wherein the glove comprises anti-fatigue gel disposed at a plurality of loci on a palmar side of the glove.

16. The glove system as recited in claim 15, wherein the anti-fatigue gel comprises a viscoelastic polymer.

17. The glove system as recited in claim 15, wherein the anti-fatigue gel comprises polyurethane.

18. The glove system as recited in claim 15, wherein the anti-fatigue gel comprises polyvinyl chloride.

19. The glove system as recited in claim 15, wherein the anti-fatigue gel comprises silicone.

20. The glove system as recited in claim 15, wherein the glove comprises grip-enhancing material disposed over the anti-fatigue gel at each of the plurality of loci.

21. The glove system as recited in claim 20, wherein the plurality of loci on the palmar side of the glove consist of:

generally over the thenar region of a human palm;

generally over the hypo-thenar region of the human palm;

generally over one or more of the metacarpophalangeal joints; and generally over the proximal phalanges.

22. The glove system as recited in claim 1, wherein the glove comprises reflective material disposed at one or more loci on a dorsal side of the glove.

23. The glove system as recited in claim 1, wherein the glove comprises magnetic fingertips.

* * * * *